US005778859A

United States Patent [19]

Takagi

[11] Patent Number: 5,778,859

[45] Date of Patent: Jul. 14, 1998

[54] EVAPORATIVE FUEL PROCESSING APPARATUS OF INTERNAL COMBUSTION ENGINE

[75] Inventor: Naoya Takagi, Susono, Japan

[73] Assignee: Toyota Jidosha Kabushiki Kaisha, Toyota, Japan

[21] Appl. No.: 856,082

[22] Filed: May 14, 1997

[30] Foreign Application Priority Data

May 15, 1996 [JP] Japan ..... 8-120386

[51] Int. Cl.[6] ..... F02M 37/04; F02M 41/14

[52] U.S. Cl. ..... 123/520; 123/674

[58] Field of Search ..... 123/516, 518, 123/519, 520, 698, 674

[56] References Cited

U.S. PATENT DOCUMENTS

| | | | |
|---|---|---|---|
| 4,961,412 | 10/1990 | Furuyama | 123/520 |
| 5,406,927 | 4/1995 | Kato et al. | 123/674 |
| 5,425,349 | 6/1995 | Nagaishi et al. | 123/674 |
| 5,520,160 | 5/1996 | Aota et al. | 123/520 |
| 5,529,047 | 6/1996 | Aota et al. | 123/674 |
| 5,546,917 | 8/1996 | Osanai et al. | 123/674 |
| 5,626,122 | 5/1997 | Azuma | 123/698 |
| 5,676,118 | 10/1997 | Saito | 123/520 |
| 5,682,862 | 11/1997 | Sato et al. | 123/520 |

FOREIGN PATENT DOCUMENTS

| | | |
|---|---|---|
| 472453A | 3/1992 | Japan . |
| 4121449A | 4/1992 | Japan . |
| 4314956A | 11/1992 | Japan . |
| 552139A | 3/1993 | Japan . |
| 7305662A | 11/1995 | Japan . |

*Primary Examiner*—Thomas N. Moulis
*Attorney, Agent, or Firm*—Kenyon & Kenyon

[57] ABSTRACT

An upper limit value of a target purge rate is set as a maximum purge rate PGRMAX, taking stability of air-fuel ratio control into consideration. On this occasion, in addition to time upper-limit purge rate PGTGT, full-opening purge rate PG 100, and limit purge rate PGLMT as maximum purge rates based on an amount of vapor desorbing from the canister, tank vapor purge rate PGTANK is obtained as a maximum purge rate based on an amount of vapor introduced directly from the fuel tank (steps 701 to 704). Then a minimum value is set as the maximum purge rate PGRMAX out of these upper limit values of the respective purge rates (step 705).

3 Claims, 10 Drawing Sheets

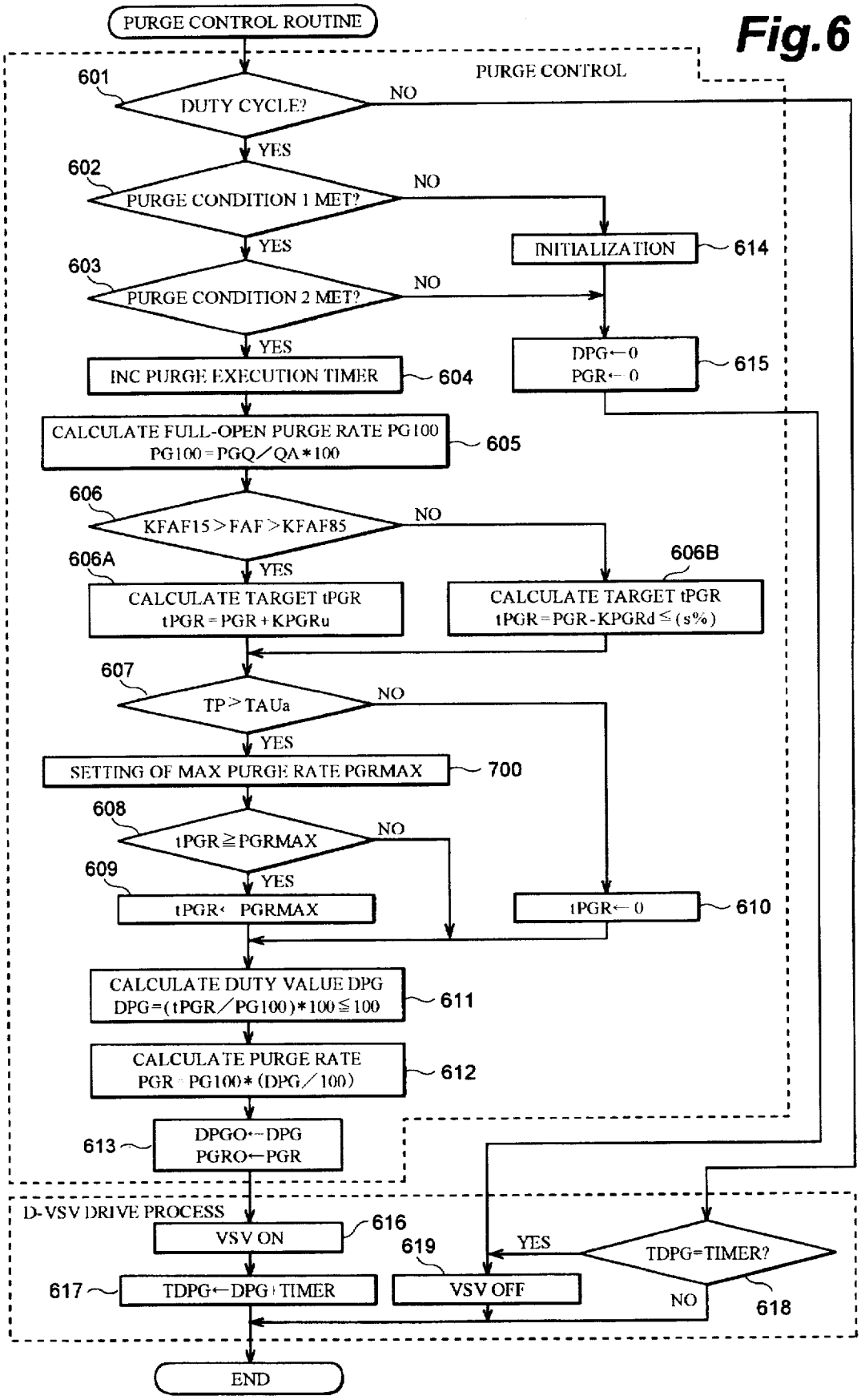
Fig.6
PURGE CONTROL ROUTINE
PURGE CONTROL
601
DUTY CYCLE?
NO
YES
602
PURGE CONDITION 1 MET?
NO
YES
INITIALIZATION
614
603
PURGE CONDITION 2 MET?
NO
YES
INC PURGE EXECUTION TIMER
604
DPG←0
PGR←0
615
CALCULATE FULL-OPEN PURGE RATE PG100
PG100=PGQ/QA*100
605
606
KFAF15>FAF>KFAF85
NO
YES
606A
CALCULATE TARGET tPGR
tPGR=PGR+KPGRu
606B
CALCULATE TARGET tPGR
tPGR=PGR-KPGRd≤(s%)
607
TP>TAUa
NO
YES
SETTING OF MAX PURGE RATE PGRMAX
700
608
tPGR≧PGRMAX
NO
YES
609
tPGR← PGRMAX
tPGR←0
610
CALCULATE DUTY VALUE DPG
DPG=(tPGR/PG100)*100≦100
611
CALCULATE PURGE RATE
PGR=PG100*(DPG/100)
612
613
DPGO←DPG
PGRO←PGR
D-VSV DRIVE PROCESS
VSV ON
616
619
YES
TDPG=TIMER?
617
TDPG←DPG+TIMER
VSV OFF
NO
618
END

EVAPORATIVE FUEL PROCESSING APPARATUS OF INTERNAL COMBUSTION ENGINE

BACKGROUND OF THE INVENTION

1. Field of the Invention

The present invention relates to an evaporative fuel processing apparatus of internal combustion engine for temporarily storing evaporative fuel generated in a fuel tank, in a canister and introducing the evaporative fuel thus stored into an intake system in accordance with the operating condition of engine.

2. Related Background Art

In general, in order to prevent the evaporative fuel (vapor) generated from a fuel tank or the like during stop of an internal combustion engine from being released to the atmosphere, the internal combustion engine is provided with an evaporative fuel processing apparatus (evaporation system) for processing such vapor. This system is arranged to make the canister temporarily adsorb the vapor thus generated, to desorb the vapor thus adsorbed from the canister and to purge it to the intake system, utilizing the negative pressure during operation of engine, and to process to burn it in a combustion chamber. If the vapor by the purge should be introduced into the intake system under such a circumstance that control of air-fuel ratio of internal combustion engine is carried out, the air-fuel ratio would become richer than a target air-fuel ratio, because the fuel of the vapor thus introduced is further added to a quantity of fuel introduced to achieve the target air-fuel ratio from a fuel injection valve, and thus it would be a factor to degrade properties of emissions. To avoid it, control of purge amount is carried out by a control valve provided in the purge passage connecting the fuel tank with the intake passage. An example of such evaporative fuel processing apparatus of internal combustion engine is disclosed in Japanese Laid-open Patent Application No. 4-72453.

SUMMARY OF THE INVENTION

The processing apparatus disclosed in Japanese Laid-open Patent Application No. 4-72453 is arranged to calculate a maximum purge rate being a rate of maximum purge amount to inlet air amount determined according to the engine operating condition and to control open/close of the purge control valve at a purge rate within the range of this maximum purge rate, thus suppressing the negative effective of the purge on the control of air-fuel ratio.

In Japanese Laid-open Patent Application No. 4-72453, however, calculation is done as focusing on only the evaporative fuel desorbing from the canister, in calculating the maximum purge rate. In fact, there exists the evaporative fuel directly purged into the intake passage without being adsorbed to the canister after having been released from the fuel tank, in addition to the evaporative fuel desorbing from the canister. Because of this, the vapor directly introduced from the fuel tank sometimes caused an appropriate maximum purge rate to be not set. Under such circumstances, it resulted in negatively affecting the control of air-fuel ratio by the purge and caused disturbance of air-fuel ratio, thus being a cause to degrade emissions.

The present invention has been accomplished to solve such problem and an object thereof is to further decrease the negative effect of the purge on the control of air-fuel ratio and to fully suppress the disturbance of air-fuel ratio and degradation of emissions, by setting the maximum purge rate in consideration of the vapor purged directly from the fuel tank into the intake passage.

The first evaporative fuel processing apparatus of internal combustion engine is an evaporative fuel processing apparatus of internal combustion engine, which has a purge passage connecting an intake passage to a canister for temporarily storing evaporative fuel generated in a fuel tank, said purge passage being provided with a control valve for opening and closing the purge passage, the evaporative fuel processing apparatus controlling open/close of the control valve so as to introduce the evaporative fuel at a predetermined purge rate into the intake passage and comprising: maximum purge rate setting means for setting a maximum purge rate according to an operating condition of an internal combustion engine; target purge rate setting means for setting a target purge rate to be a target of control in accordance with the operating condition of the internal combustion engine, within the range of the maximum purge rate; and control means for controlling open/close of the control valve, based on the target purge rate set by the target purge rate setting means. Then, the processing apparatus is characterized in that the maximum purge rate setting means comprises at least first purge rate defining means for defining an upper limit of purge rate, based on evaporative fuel introduced directly into the intake passage after generated in the fuel tank.

As the temperature of the fuel tank gradually increases because of the operation of engine, the quantity of generation of the evaporative fuel increases therewith and the quantity of the evaporative fuel introduced directly into the intake passage without being adsorbed to the canister also increases. Under such circumstances, the effect of the evaporative fuel directly introduced from the fuel tank increases greatly as compared with the effect of the evaporative fuel desorbing from the canister to be introduced into the intake passage. Thus, the first purge rate defining means defines the upper limit of purge rate, based on the evaporative fuel introduced directly from the fuel tank into the intake passage and the maximum purge rate is set in consideration of the upper limit of purge rate obtained here.

The second evaporative fuel processing apparatus of internal combustion engine is characterized in that the maximum purge rate setting means of the first apparatus further comprises second purge rate defining means for defining an upper limit of purge rate, based on the evaporative fuel desorbing from the canister, and the aforementioned maximum purge rate setting means sets a minimum value out of the upper limits of purge rate defined by the first and second purge rate defining means, as the maximum purge rate.

This configuration permits an appropriate maximum purge rate to be set according to the operating condition, based on the both values of the upper limit of purge rate based on the evaporative fuel desorbing from the canister and the upper limit of purge rate based on the evaporative fuel introduced directly from the fuel tank into the intake passage.

The third evaporative fuel processing apparatus of internal combustion engine is an evaporative fuel processing apparatus of internal combustion engine according to the first and second apparatus, further comprising pressure detecting means for detecting a pressure in the fuel tank, wherein the first purge rate defining means defines the upper limit of purge rate, based on a detection result of the pressure detecting means. The evaporative fuel generated in the fuel tank and then introduced directly from the fuel tank into the intake passage can be grasped at an early stage by detecting the pressure in the fuel tank, and thus the pressure detecting means permits the first maximum purge rate defining means to perform the defining process at an early stage even with a sudden change in the pressure in the fuel tank, in response thereto.

The purge rate is defined as purge rate=(quantity of gas passing through the control valve)/(quantity of intake air), in which (quantity of gas passing through the control valve) means the sum of quantity of evaporative fuel passing through the control valve and quantity of air flowing through an air opening of canister into the intake passage and in which (quantity of intake air) means the sum of quantity of air directly introduced into the intake passage and quantity of air flowing through the air opening of canister into the intake passage.

The present invention will be more fully understood from the detailed description given hereinbelow and the accompanying drawings, which are given by way of illustration only and are not to be considered as limiting the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will be apparent to those skilled in the art from this detailed description.

BRIEF DESCRIPTION OF THE DRAWINGS

FIG. 6 is a flowchart to show control procedures according to the purge control of the evaporative fuel processing apparatus shown in FIG. 1.

DESCRIPTION OF THE PREFERRED EMBODIMENTS

Embodiments of the present invention will be described with reference to the accompanying drawings.

Figure 1:
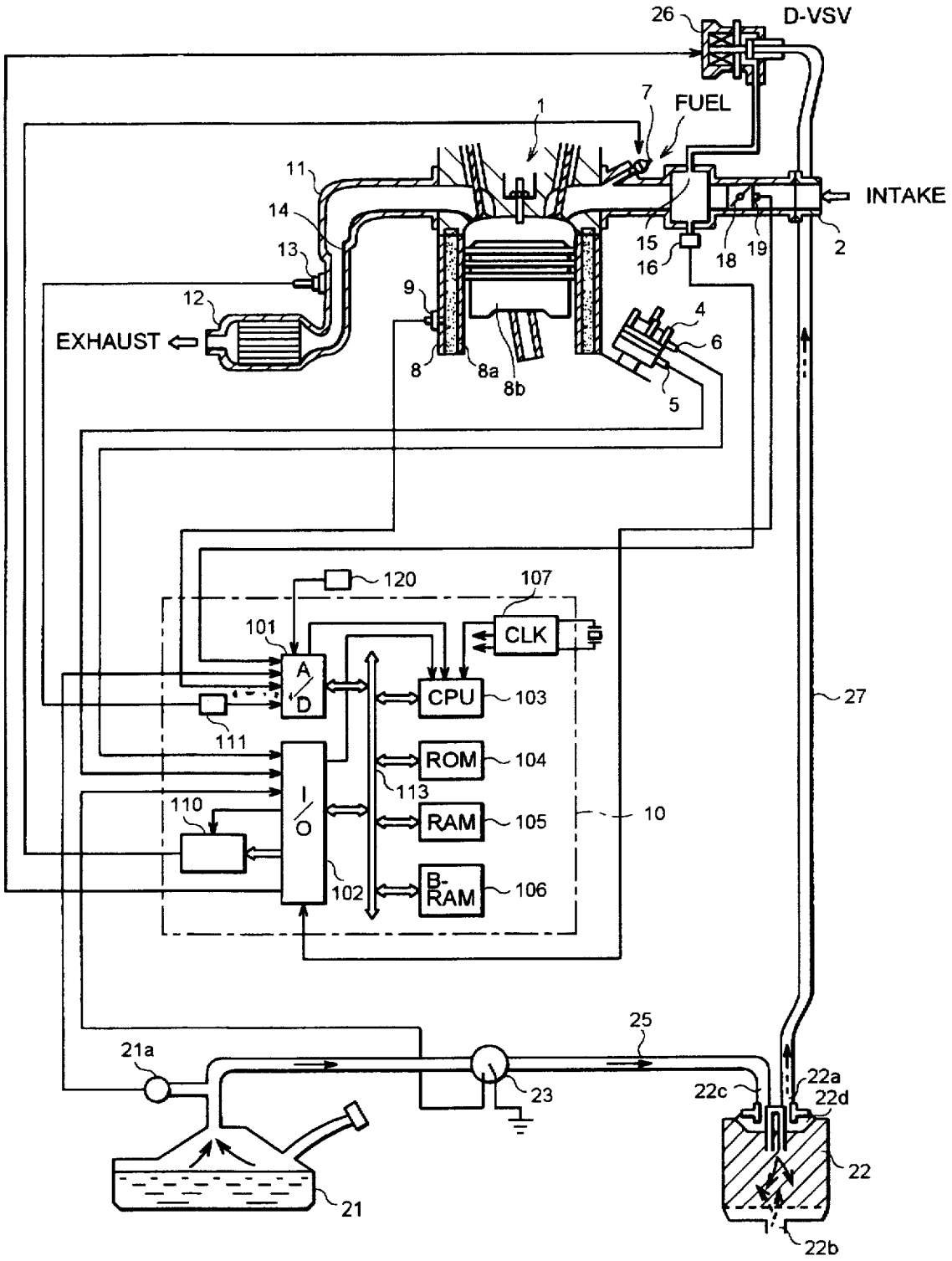
FIG. 1 is an overall structural drawing to show the overall configuration of the evaporative fuel processing apparatus.

FIG. 1 schematically shows an internal combustion engine of an electronic control fuel injection system provided with an evaporative fuel processing apparatus according to the present invention. A throttle valve 18 is provided downstream of an air flow meter (not illustrated) for measuring a flow rate of air in an intake passage 2 of the internal combustion engine 1, and a throttle-valve-travel sensor 19 for detecting the valve travel of throttle valve 18 is provided on a shaft of the throttle valve 18. A fuel injection valve 7 for supplying pressurized fuel from a fuel supply system to an inlet port for each cylinder is provided downstream of the throttle valve 18 in the intake passage 2.

A distributor 4 is provided with a crank angle sensor 5 for generating pulse signals for detection of reference position every 720° CA of rotation of its shaft and a crank angle sensor 6 for generating pulse signals for detection of reference position every 30° CA of rotation of its shaft, when calculated as a crank angle (CA), for example. These pulse signals from the crank angle sensors 5, 6 are used as interrupt request signals of fuel injection timing, reference timing signals of ignition timing, interrupt request signals of fuel injection quantity arithmetic control, and so on. These signals are supplied to an I/O interface 102 of control circuit 10 and the outputs from the crank angle sensor 6 among them are supplied to an interrupt terminal of CPU 103.

Further, a water-temperature sensor 9 for detecting the temperature of cooling water is provided in a cooling water passage 8 of a cylinder block 8*a* of the internal combustion engine 1, and the cylinder block 8*a* surrounds a piston 8*b*. Vapor and fuel from the intake passage 2 are provided to a cavity above the piston 8*b*. The water-temperature sensor 9 generates an electric signal of analog voltage according to the temperature THW of cooling water. Also, an atmosphere-temperature sensor 120 also generates an electric signal of analog voltage according to the temperature of the atmosphere, and the outputs from these sensors are supplied to an A/D converter 101. A three way catalytic converter 12 for simultaneously cleaning three deleterious components HC, CO, NOx in emissions is provided in an exhaust pipe 14 downstream of exhaust manifold 11. An $O_2$ sensor 13, which is a kind of an air-fuel ratio sensor, is provided downstream of the exhaust manifold 11 and upstream of the catalytic converter 12. The $O_2$ sensor 13 generates an electric signal according to a concentration of oxygen components in the emissions. Namely, the $O_2$ sensor 13 supplies different output voltages, depending upon whether the air-fuel ratio is on the rich side or on the lean side with respect to the theoretical air-fuel ratio, through a signal processing circuit 111 of control circuit 10 to the A/D converter 101. Further, the I/O interface 102 is arranged to receive supply of a detection signal of a pressure sensor 16 for detecting the pressure in the surge tank and an on/off signal of the ignition switch not illustrated.

The internal combustion engine 1 is provided with an evaporation system for preventing the vapor evaporating from the fuel tank 21 from being released into the atmosphere. This evaporation system comprises a charcoal canister (hereinafter referred to as a canister) 22 and an electric purge flow rate control valve (D-VSV) 26. The canister 22 has a purge port 22*a*, an air port 22*b*, and a tank port 22*c*, wherein the purge port 22*a* and tank port 22*c* are in communication with each other through a relay chamber 22*d* in the canister 22. A vapor passage 25 connects the tank port 22*c* of canister 22 with the top panel of fuel tank 21 to make the canister adsorb the vapor evaporating from the fuel tank 21. The air port 22*b* of canister 22 is open to the atmosphere and the purge port 22*a* is connected to a purge port 15 of intake passage 2 by a purge passage 27.

Provided midway in the vapor passage 25 is a tank internal-pressure sensor 21*a* for detecting the pressure inside the fuel tank 21, and a detection result of this sensor 21*a* is supplied to the A/D converter 101 to be used in detection of anomalies such as perforation of tank 21 and in purge control described hereinafter. Also provided midway in the vapor passage 25 is a tank internal-pressure control valve 23 for opening when the pressure inside the fuel tank 21 becomes at least a predetermined pressure. A switch for indicating an open/close status is attached to this internal-pressure control valve 23 and the open/close status of the internal-pressure control valve 23 is put into the I/O interface 102. D-VSV 26 is a solenoid-controlled valve provided midway in the purge passage 27 for purging the vapor adsorbed to the canister 22 to the downstream side of the throttle valve 18 in the intake passage 2, which can open and close by supply of electric signal from the control circuit 10 to duty-control the quantity of vapor flowing into the intake passage 2.

In the above structure, when the ignition switch not illustrate is flipped on, the control circuit 10 is powered to start programs, then to capture outputs from the respective sensors and to control the fuel injection valve 7 and the other actuators. The control circuit 10 is configured, for example, using a microcomputer and comprises, in addition to the A/D converter 101, I/O interface 102, and CPU 103 described above, an ROM 104 storing the control programs described hereinafter, an RAM 105, a back-up RAM 106 for retaining information also after off of the ignition switch, a clock generating circuit (CLK) 107, and so on, which are connected by a bi-directional bus 113.

In this control circuit 10, an injection control circuit 110 including a down counter, a flip-flop, and a drive circuit is for controlling the fuel injection valve 7. Namely, when a fuel injection amount TAU is calculated by correcting a basic injection amount Tp calculated from inlet air quantity and engine RPM with an operating condition of engine, the fuel injection amount TAU is preset in the down counter of the injection control circuit 110 and the flip-flop is also set, whereupon the drive circuit starts operation of the fuel injection valve 7. On the other hand, the down counter counts clock signals (not shown). When the carry-out terminal thereof finally reaches the level "1," the flip-flop is reset and the drive circuit stops the operation of the fuel injection valve 7. In other words, since the fuel injection valve 7 is operated by the foregoing fuel injection amount TAU, the fuel of an amount according to the fuel injection amount TAU is fed into the combustion chamber of the internal combustion engine 1.

Interrupts of CPU 103 occur after completion of A/D conversion of the A/D converter 101, at the time when the I/O interface 102 receives a pulse signal from the crank angle sensor 6, at the time when it receives an interrupt signal from the clock generating circuit 107, and so on.

Figure 2:
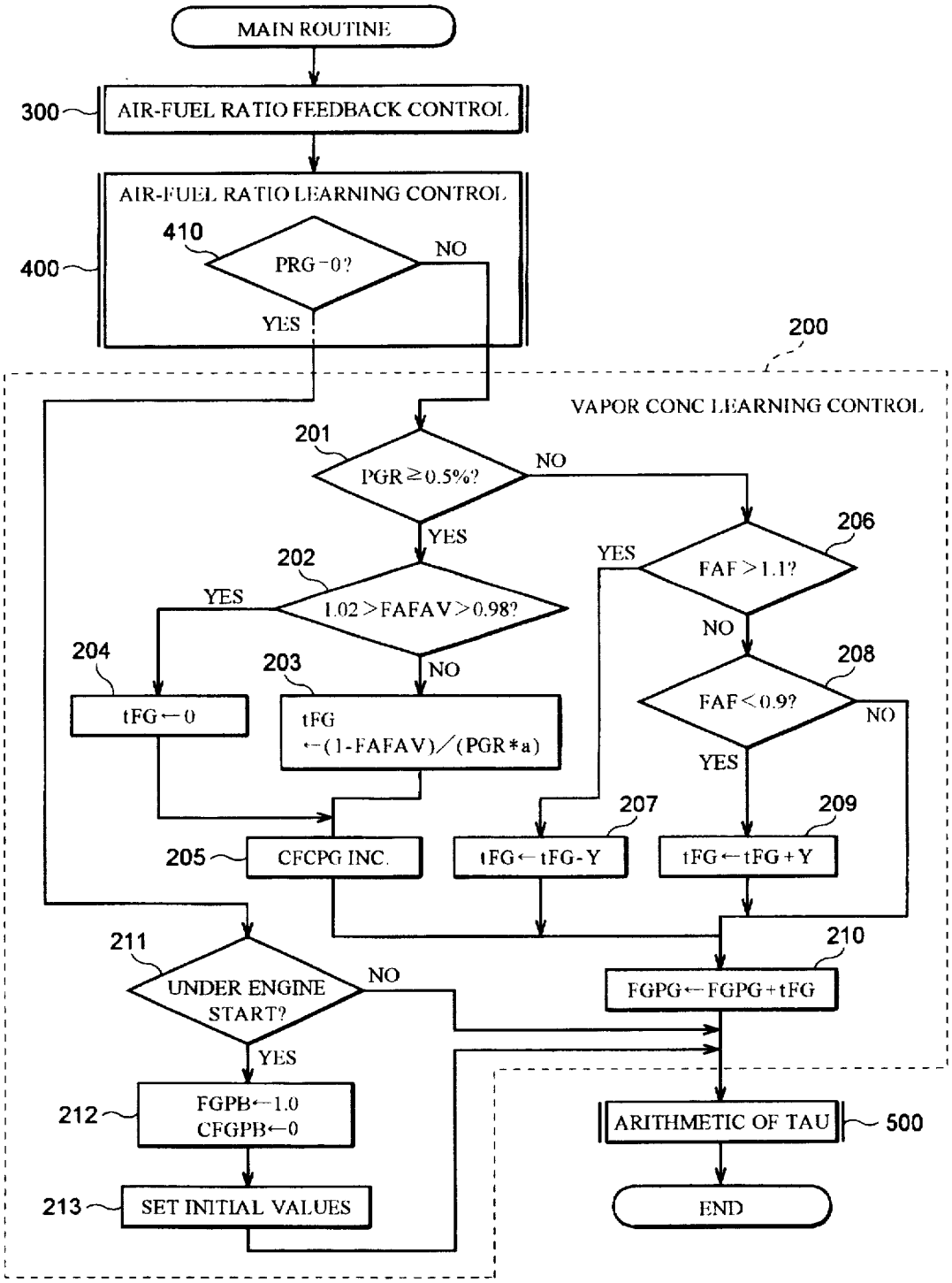
FIG. 2 is a flowchart to show basic control procedures according to the air-fuel ratio control of the evaporative fuel processing apparatus shown in FIG. 1.

FIG. 2 shows the main routine concerning the control of air-fuel ratio, vapor concentration learning control, and so on of the control device 10 of internal combustion engine shown in FIG. 1. The control device 10 performs feedback control of air-fuel ratio at step 300 and then executes learning control of air-fuel ratio at next step 400. In this learning control step of air-fuel ratio whether purge is under way or not is determined by whether the purge rate PGR described hereinafter is 0 or not. With PGR=0, the learning control of air-fuel ratio is carried out subsequently and thereafter the vapor concentration learning control is executed (step 200). With PGR≠0, the flow proceeds to step 201 in the vapor concentration learning control executed in step 200. Then the vapor concentration learning control of step 200 updates the vapor concentration FGPG and then ends. Then the flow proceeds to step 500 to carry out calculation of the fuel injection amount TAU.

Figure 3:
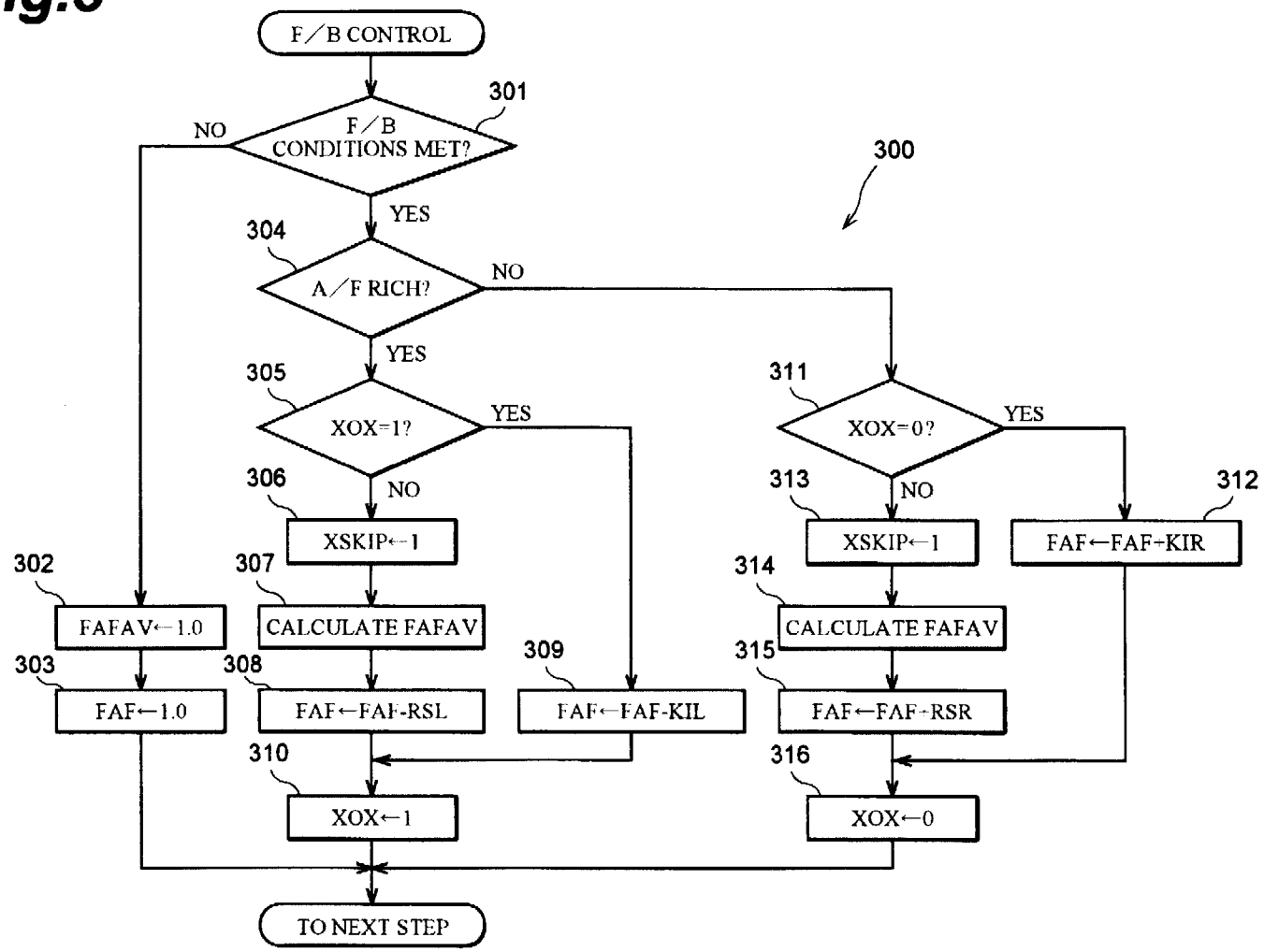
FIG. 3 is a flowchart to show the details of the air-fuel ratio feedback control in step 300 of FIG. 2.

Here, the details of the air-fuel ratio feedback control at step 300 are shown in FIG. 3. In the air-fuel ratio feedback control, first, it is determined at step 301 whether feedback (F/B) conditions are met. The F/B conditions are met, for example, when the following conditions are all satisfied: (1) the engine is not under start; (2) the fuel is not cut; (3) water temperature ≧40° C.; (4) activation of the air-fuel ratio sensor is completed.

When step 301 results in determining that the F/B conditions are not met, the flow proceeds to step 302 to set a reference value 1.0 as an average FAFAV of air-fuel ratio feedback correction amount. Then at next step 303 the reference value 1.0 is set as an air-fuel ratio feedback correction amount FAF and this routine is ended. On the other hand, when step 301 results in determining that the F/B conditions are all met, the flow goes to step 304 to determine whether the air-fuel ratio (A/F) is rich. When the air-fuel ratio is determined as rich, the flow goes to step 305, in which whether a previous air-fuel ratio was rich or not is determined by whether a flag XOX is 1 (indicating that the previous ratio was rich) or 0 (indicating that the previous ratio was lean). When the previous ratio was lean and when the ratio is inverted this time to rich, the flow goes to step 306 to set a skip flag XSKIP (XSKIP←1). Then step 307 is carried out to calculate the average FAFAV of the previous air-fuel ratio feedback correction amount FAF and the present air-fuel ratio feedback correction amount FAF and then step 308 is carried out to skip-decrease the air-fuel ratio feedback correction amount FAF by a predetermined skip value RSL. When step 305 results in determining that the previous ratio was rich, the flow goes to step 309 to decrease the air-fuel ratio feedback correction amount FAF by a predetermined integral value KIL. After completion of step 308 and step 309, the rich flag XOX, indicating that the previous air-fuel ratio was rich, is set (to 1) and then this routine is ended. However, RSL>KIL.

Further, when step 304 results in determining that the air-fuel ratio is lean, the flow goes to step 311, in which whether the previous air-fuel ratio was also lean is determined by whether the flag XOX is 0 (indicating that the previous ratio was lean) or 1 (indicating that the previous ratio was rich). When the previous ratio was rich and when the ratio is inverted this time to lean, the flow proceeds to step 313 to set the skip flag XSKIP (XSKIP←1). Then step 314 is carried out to calculate the average FAFAV of the previous air-fuel ratio feedback correction amount FAF and the present air-fuel ratio feedback control amount FAF. Further, step 315 is carried out to skip-increase the air-fuel ratio feedback correction amount FAF by a predetermined skip value RSR. When step 311 results in determining that the previous ratio was also lean, the flow goes to step 312 to increase the air-fuel ratio feedback correction amount FAF by a predetermined integral value KIR. After completion of step 312 and step 315, step 316 is then carried out to set the rich flag XOX indicating that the previous air-fuel ratio was lean (to 0) and this routine is ended.

Figure 4:
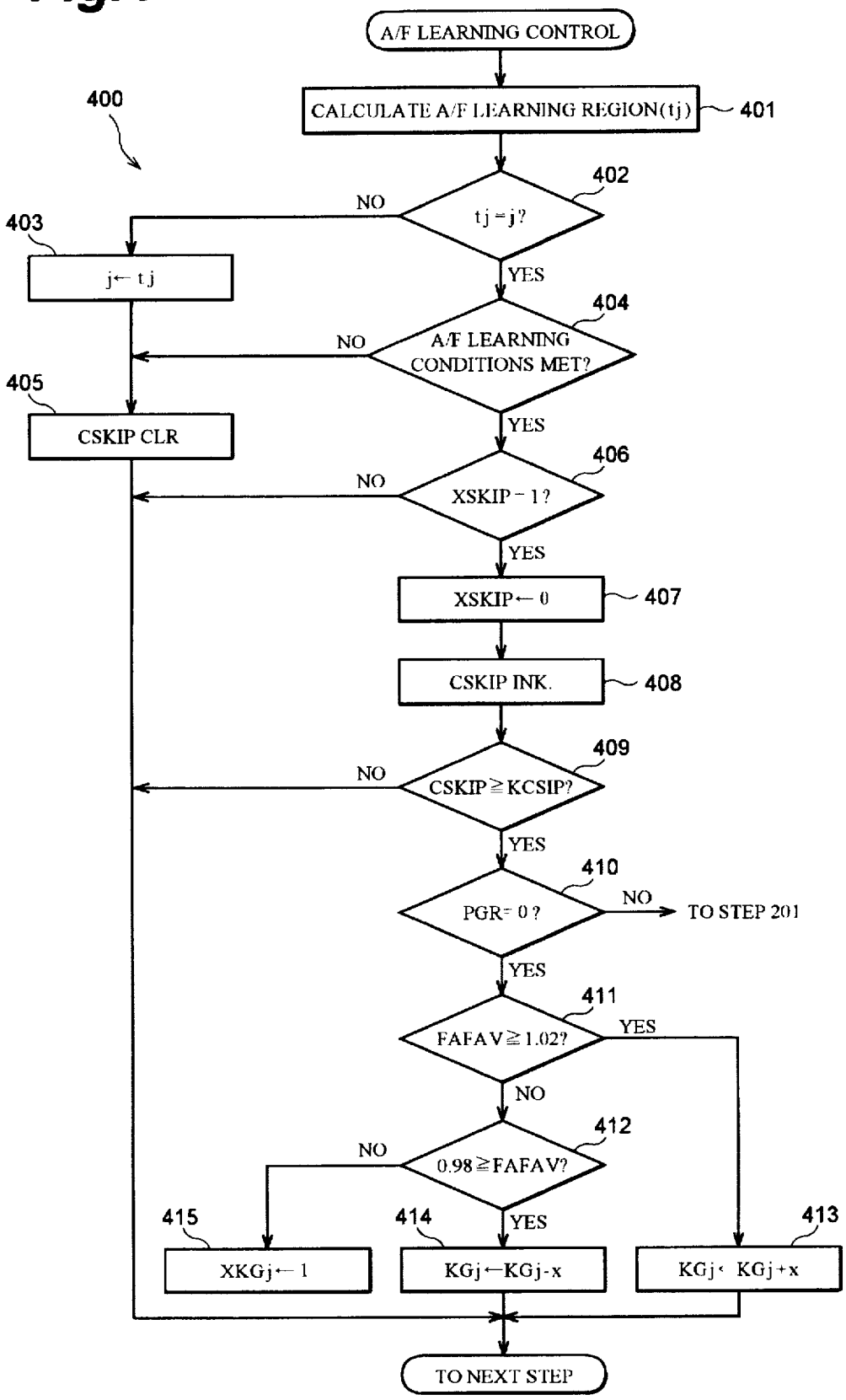
FIG. 4 is a flowchart to show the details of the air-fuel ratio learning control in step 400 of FIG. 2.

After the air-fuel ratio feedback control in step 300 has been completed in this way, the flow goes to step 400 to carry out the air-fuel ratio learning control. The flow of this air-fuel ratio learning control is shown in FIG. 4. At step 401 an air-fuel ratio learning region tj is calculated. This air-fuel ratio learning region tj is determined by a pressure of inlet pipe as to which one of air-fuel ratio learning regions, for example, segmental regions KG1 to KG7. At next step 402 it is determined whether a number j of the air-fuel ratio learning region obtained last time is equal to the air-fuel ratio learning region tj calculated this time. When step 402 results in determining that the air-fuel ratio learning region tj calculated this time is different, the flow goes to step 403 to store the present air-fuel ratio learning region tj as a previous air-fuel ratio learning region j. Then step 405 is carried out to clear a skip number counter CSKIP and this routine is ended.

On the other hand, when step 402 results in determining the air-fuel ratio learning region tj calculated this time is the same, the flow goes to step 404 to determine whether the air-fuel ratio learning conditions are met. The air-fuel ratio learning conditions are met, for example, when the following conditions are all satisfied: (1) the air-fuel ratio feedback is under way; (2) there is no increase in the air-fuel ratio feedback correction amount; (3) water temperature ≧80° C. When step 404 results in determining that the air-fuel ratio learning conditions are not met, the flow goes to step 405 to clear the skip number counter CSKIP and then this routine is ended. When the air-fuel ratio learning conditions are met, the flow goes to step 406.

Step 406 determines whether the skip flag XSKIP is 1. When XSKIP=0, this routine is ended. When XSKIP =1, step 407 is carried out to set the skip flag XSKIP to 0 and thereafter step 408 is carried out to increment (or increase) the skip number counter CSKIP. Then step 409 is carried out to determine whether this skip number counter CSKIP is not less than a predetermined value KCSKIP, for example, "3." If CSKIP <KCSKIP then this routine is ended. If CSKIP≧KCSKIP then the flow goes to step 410. Since the advance to step 410 means that the feedback control is under way in a same air-fuel ratio learning region, it is determined here whether the purge rate PGR is 0.

When step 410 results in determining that the purge rate is not 0, the flow goes to step 201 shown in FIG. 2; if the purge rate is 0 then the flow goes to step 411 to determine whether the average FAFAV of air-fuel ratio feedback correction amount is not less than a predetermined value (1.02 in this example). At next step 412 it is determined whether the average FAFAV of air-fuel ratio feedback correction amount is not more than a predetermined value (0.98 in this example). In other words, steps 411, 412 of this example are arranged to determine whether the average FAFAV of air-fuel ratio feedback correction amount has a deviation of not less than 2%. When step 411 results in determining that the average FAFAV of air-fuel ratio feedback correction amount is 2 or more % larger, the flow goes to step 413 to increase a learning value KGj in this learning region by a predetermined value x. When step 412 results in determining that the average FAFAV of air-fuel ratio feedback correction amount is 2 or more % smaller, the flow goes to step 414 to decrease the learning value KGj in this learning region by the predetermined value x. If steps 411, 412 result in determining that the average FAFAV of air-fuel ratio feedback correction amount is in deviation less than ±2 %, the flow goes to step 415 to set an air-fuel ratio learning completion flag XKGj in this learning region and then this air-fuel ratio learning control routine is ended.

When the air-fuel ratio learning control in step 400 ends in this way, the flow goes to step 200 to execute the vapor concentration learning control. This vapor concentration learning control is shown in FIG. 2. When step 410 of FIG. 4 results in determining that the purge rate PGR is not 0, the flow goes to step 201 of FIG. 2 to determine whether the purge rate PGR is not less than a predetermined value (0.5% in this example). When step 201 results in determining that PGR ≧0.5%, the flow goes to step 202 to determine whether the average FAFAV of air-fuel ratio feedback correction amount is in deviation within ±2%. If 0.98 <FAFAV<1.02 then the flow goes to step 204 to set a vapor concentration update value tFG to 0 and then goes to step 205. If FAFAV ≦0.98 or if FAFAV≧1.02, the flow goes to step 203 to obtain a vapor concentration update value tFG per purge rate by equation: tFG←(1−FAFAV)/(PGR ×a) and then goes to step 205. In this equation, a is a predetermined constant. Then step 205 is carried out to increment a vapor concentration update number CFGPG and then the flow goes to step 210.

On the other hand, when step 201 results in determining that the purge rate PGR is less than 0.5%, which means that the accuracy of vapor concentration update is poor, the flow goes to step 206 and the subsequent steps to determine whether the deviation of the air-fuel ratio feedback correction amount FAF is large. In this example the deviation of air-fuel ratio feedback correction amount FAF is set within ±10%. It is thus determined at step 206 whether the air-fuel ratio feedback correction amount FAF is greater than 1.1. At next step 208 it is determined whether the air-fuel ratio feedback correction amount FAF is smaller than 0.9. When FAF >1.1, the flow proceeds from step 206 to step 207 to decrease the vapor concentration update value tFG by a predetermined value Y and then proceeds to step 210. When FAF <0.9, the flow proceeds from step 206 through step 208 to step 209 to increase the vapor concentration update value tFG by the predetermined value Y and then proceeds to step 210. Further, when 0.9≦FAF≦1.1, step 206 and step 208 both result in NO and then the flow goes straight to step 210.

At step 210 the vapor concentration FGPG is updated by adding the vapor concentration update value tFG to the vapor concentration FGPG and then the flow goes to the next arithmetic routine 500 of the fuel injection amount TAU. A value of this vapor concentration FGPG becomes smaller as the vapor concentration becomes higher. When no purge is carried out in the air-fuel ratio learning control of step 400 to indicate the purge rate of 0, the flow goes from step 400 to step 211. At step 211 it is determined whether the engine is under start. When the engine is not under start, the flow goes straight to step 500; however, if the engine is under start, the flow goes to step 212. At step 212 the vapor concentration FGPG is set to the reference value 1.0 and the vapor concentration update number CFGPG is cleared. Then the flow goes to step 213. At step 213 initial values are set to the other variables and then the flow goes to step 500.

Figure 5:
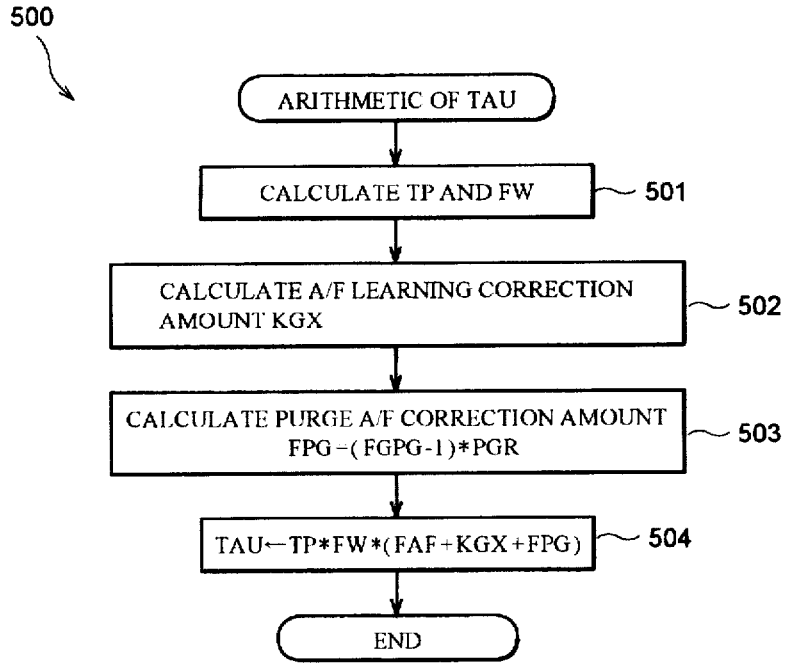
FIG. 5 is a flowchart to show the details of the arithmetic process of the fuel injection amount in step 500 of FIG. 2.

The details of the arithmetic process of the fuel injection amount TAU in step 500 are shown in FIG. 5. In the arithmetic process of the fuel injection amount TAU, step 501 is first carried out to calculate a basic fuel injection amount Tp and various basic correction amount FW, based on the engine rotation speed and engine load of data stored. Then next step 502 is carried out to obtain an air-fuel ratio learning value KGX at a present inlet pipe pressure from an air-fuel ratio learning value KGj of adjacent learning region. Further, next step 503 is carried out to calculate a purge air-fuel ratio correction amount FPG by the following equation.

$$FPG=(FGPG-1)\times PGR$$

Finally, step 504 is carried out to calculate the fuel injection amount TAU by the following equation and then the main routine is ended.

$$TAU=TP\times FW\times(FAF+KGX+FPG)$$

Next described referring to FIG. 6 is the purge control in the evaporative fuel processing apparatus shown in FIG. 1 and the drive process of D-VSV 26 duty-controlled as provided midway in the purge passage 27.

First, whether a duty cycle or not is determined at step 601. This duty cycle is normally about 100 ms. When step 601 results in determination of not being a duty cycle, the flow goes to step 618 to determine whether a power supply termination time TDPG of D-VSV 26 has come, by determining whether TDPG=TIMER. When TDPG≠TIMER, this routine is ended directly. When TDPG=TIMER, the flow goes to step 619 to stop power supply to D-VSV 26 and to turn it off.

On the other hand, when step 601 results in determination of a duty cycle, the flow goes to step 602 to determine whether a first purge condition is satisfied. The first purge determination condition is met when the air-fuel ratio learning conditions except for fuel cut are satisfied. When the first purge determination condition is not met, the flow goes to step 614 to initialize the related data stored in the RAM and thereafter step 615 is carried out to clear the duty value DPG and purge rate PGR. Then the flow goes to step 619 to turn the D-VSV 26 off (or close the valve).

Figure 9A:
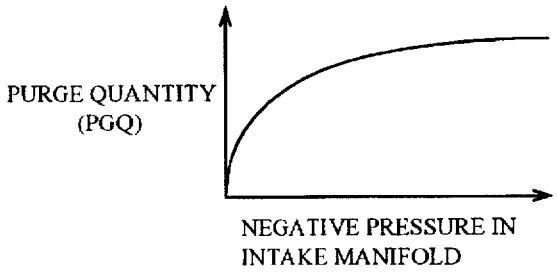
FIG. 9A is a graph to show purge flow rate characteristics against negative pressure of intake manifold.

When step 602 results in determining that the first purge determination condition is met, the flow goes to step 603 to determine whether a second purge determination condition is satisfied. The second purge determination condition is met when the fuel is not cut and when the air-fuel ratio learning completion flag XKGj=1 in the learning completion region is satisfied. When the second purge determination condition is not met, the flow goes to step 615 to clear the duty value DPG and purge rate PGR and then the flow goes to step 619 to turn the D-VSV 26 off. When the second purge determination condition is met, the flow goes to step 604 to increment a purge execution timer CPGR and then goes to step 605 to calculate a purge rate PG 100 at full opening of D-VSV 26 by the following equation from a ratio of purge flow quantity at full opening of D-VSV 26 (see FIG. 9A) to intake air quantity QA.

$$PG100=PGQ/QA\times100$$

Next step 606 is carried out to determine whether the air-fuel ratio feedback correction amount FAF is within a predetermined range (KFAF 85<FAF<KFAF 15). If it is within this predetermined range, the engine operating condition is determined as stable and step 606A is carried out to increase the target purge rate tPGR by the following equation.

$$tPGR=PGR+KPGRu$$

On the other hand, if the air-fuel ratio feedback correction amount FAF is out of this predetermined range, the engine operating condition is determined as unstable and the flow goes to step 606B to decrease the target purge rate tPGR by the equation of tPGR=PGR−KPGRd. KPGRu and KPGRd are predetermined constants. It is, however, noted that the minimum value of tPGR is limited to S % shown in FIG. 9B. A reason of this limitation to the minimum value S % of the target purge rate is for preventing disturbance of air-fuel ratio due to purge. The maximum value of target purge rate is also limited in steps 700, 608, 609 as described below.

After the target purge rate tPGR has been calculated in this way, step 607 is carried out to make the following determination. Namely, when purge at the target purge rate tPGR calculated is carried out, the fuel injection amount TAU needs to be decreased in order to keep the same air-fuel ratio. If the fuel injection amount TAU at this time becomes smaller than a minimum fuel injection amount TAUMIN, the engine will transiently become unstable. Thus, if at step 607 the fuel injection amount TAU is smaller than a value TAUa obtained by adding a predetermined value a to the minimum fuel injection amount TAUMIN (or when step 607 results in NO), step 610 is carried out to set the target purge rate tPGR to 0 so as not to perform purge. On the other hand, if at step 607 Tp≧TAUa then step 700 is carried out to calculate the maximum purge rate PGRMAX defining the upper limit value of the target purge rate tPGR. This calculation process of the maximum purge rate PGRMAX will be described hereinafter.

Next, at step 608 and step 609, the target purge rate tPGR is guarded by the maximum purge rate PGRMAX. Namely, the target purge rate tPGR is compared with the maximum purge rate PGRMAX, and if tPGR<PGRMAX then the flow goes straight to step 611; if tPGR ≧PGRMAX then the flow goes to step 609 to guard the target purge rate tPGR by the maximum purge rate PGRMAX and then goes to step 611.

Next, at step 611, the duty value, which is a time for opening the D-VSV 26, is calculated by the following equation.

$$DPG=(tPGR/PG\ 100)\times100$$

It is noted that the maximum value of this duty value DPG is 100%. Next at step 612 the purge rate PGR is calculated by the following equation.

$$PGR=PG\ 100\times(DPG/100)$$

After this, step 613 is carried out to store the duty value DPG as a previous value DPG0 in the RAM 105 and to store the purge rate PGR as a previous purge rate PGR0 in RAM 105.

After completion of the purge control as described, the flow goes to step 616 to power the D-VSV 26 and to turn it on and then step 617 is carried out to calculate the power supply termination time TDPG of D-VSV 26. Then this routine is ended.

Figure 7:
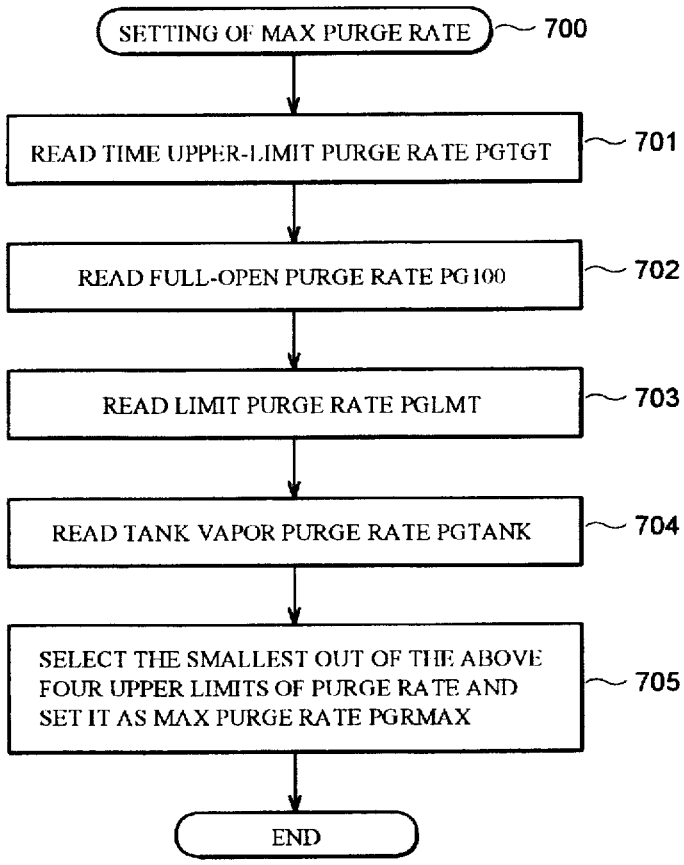
FIG. 7 is a flowchart to show the details of the setting process of maximum purge rate in step 700 of FIG. 6.

Here, the setting process of the maximum purge rate PGRMAX executed in step 700 is described referring to FIG. 7. This maximum purge rate PGRMAX is a value defining the upper limit value of the target purge rate tPGR in consideration of stability of air-fuel ratio control, for which a minimum value is selected out of the following four types of upper limit values of purge rate.

Figure 9B:
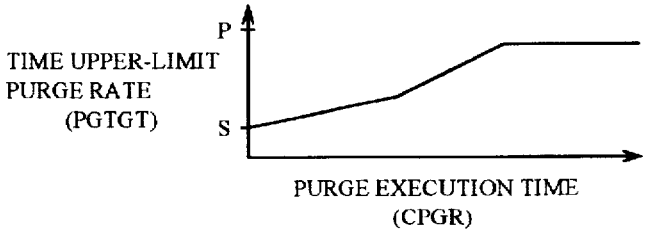
FIG. 9B is a graph to show the relation of time upper-limit purge rate versus purge execution time.

First, at step 701 a time upper-limit purge rate PGTGT is read. This time upper-limit purge rate PGTGT is an upper limit value of purge rate determined according to the purge execution time (CPGR). The relation is preliminarily mapped between the purge execution time (CPGR) and the upper limit value of purge rate as shown in FIG. 9B, and upon this read the map is searched in accordance with a time of lapse after start of purge to read an upper limit value of purge rate corresponding thereto. By effecting such a limitation that the purge rate gradually increases according to the purge execution time as described, the influence of disturbance of air-fuel ratio due to purge can be decreased.

Then step 702 is carried out to read a value of full-opening purge rate PG 100. This full-opening purge rate PG 100 is a purge rate determined by a rate of purge flow quantity and intake air quantity when the D-VSV 26 is fully open, and this value was already calculated at step 605. Therefore, the value of PG 100 calculated at step 605 is read here. That is, the maximum purge rate setting means 700 further comprises the purge rate defining means 702 for defining an upper limit of purge rate, based on evaporative fuel desorbing from the canister 22.

Then step 703 is carried out to read an upper limit value (limit purge rate PGLMT) of the target purge rate determined by the relation to the fuel injection amount. If a rate of a vapor amount introduced by the purge to a total vapor amount introduced into the combustion chamber exceeds a certain rate (40%, for example), drivability will be degraded by increase in dispersion among cylinders. Taking this point into consideration, the upper limit value of target purge rate is specified by this process.

Further, step 704 is carried out to read a tank vapor purge rate PGTANK. This tank vapor purge rate PGTANK is a value to specify an upper limit value of the target purge rate taking account of influence of vapor generated in the fuel tank 21 and introduced directly into the intake passage 2 through the D-VSV 26 without being adsorbed to the canister 22.

Figure 8:
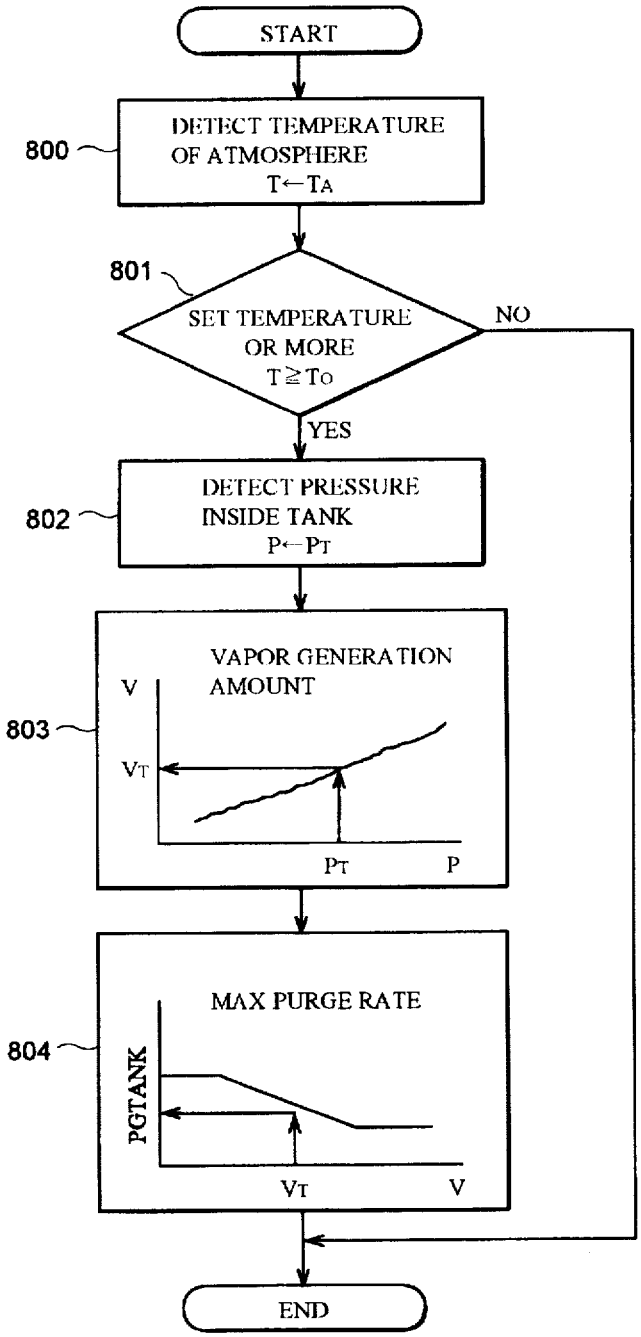
FIG. 8 is a flowchart to show the setting process of tank vapor purge rate PGTANK in step 703 of FIG. 7.

Here, a calculation flow of the tank vapor purge rate PGTANK is shown in FIG. 8. First, step 800 is carried out to detect the temperature of the atmosphere TA and then step 801 is carried out to determine whether the temperature of the atmosphere TA is not less than a predetermined set temperature T0 (30° C., for example). At this time, if the temperature of the atmosphere TA is smaller than the set temperature T0, then this routine is ended as determining that an amount of the vapor in the fuel tank 21 is not so large as it affects the purge control. On the other hand, if the temperature of the atmosphere TA is not less than the set temperature TO, step 802 is carried out to detect the pressure PT in the fuel tank 21 from the detection result of the tank internal-pressure sensor 21*a*. Then step 803 is carried out to estimate an amount of the vapor generated at present in the fuel tank 21, based on the detection result of the tank-internal pressure sensor 21*a*, from a map indicating the relation between the pressure PT in the fuel tank 21 and the amount of vapor generated, which was preliminarily obtained empirically. Also, step 804 is carried out using a map indicating the relation between the amount of vapor generated and the upper limit value of target purge rate on that occasion, preliminarily obtained empirically, to obtain the tank vapor purge rate PGTANK as an upper limit value of target purge rate by searching the map, based on the amount of generation of vapor obtained at step 803, and then this routine is ended.

Again returning to FIG. 7, after the time upper-limit purge rate PGTGT, full-opening purge rate PG 100, limit purge rate PGLMT, and tank vapor purge rate PGTANK have been obtained in step 701 to step 704 as described, step 705 is carried out to select a minimum upper limit value of purge rate out of the upper limit values of purge rate thus obtained and to set it as a maximum purge rate PGRMAX. Based on the maximum purge rate PGRMAX thus set, step 608 and step 609 are carried out to guard the upper limit of target purge rate tPGR and then the aforementioned flow of step 611 and the subsequent steps is carried out. Accordingly, since the target purge rate tPGR is limited at least to a purge rate not more than the tank vapor purge rate PGTANK, the purge control can be carried out in the optimum range of purge rate even under circumstances of increase in the amount of vapor directly purged from the fuel tank 21 without being adsorbed to the canister 22.

Since the maximum purge rate PGRMAX is set in this way, the purge rate can be limited even in the state wherein the limitation by the maximum purge rate in the purge correction amount is not effected, for example, because the vapor generation amount is not so large. Therefore, the tank vapor can be prevented from being purged more than required, an amount of vapor adsorbed to an adsorbing material in the canister 22 is increased, and thus the vapor can be purged after once reserved in the canister. Since this limitation of purge amount decreases the change of vapor concentration in the intake air due to a change in the load on the internal combustion engine, correction becomes easier. Further, even when the vapor generation amount suddenly changes because of a change in the environment, the properties of fuel, and the like, the limitation of purge amount can respond quickly thereto and a period of disturbance of air-fuel ratio can be decreased as compared with the case for learning and correcting the vapor concentration.

Japanese Laid-open Patent Application No. 7-305662 also discloses the technology for learning each of the amount of evaporative fuel emitted from the canister and the amount of evaporative fuel directly introduced from the fuel tank and for correcting the fuel injection amount, but this method includes a possibility of causing a delay in updating the learning results because of a temporal delay before detection of vapor generated in the fuel tank. More specifically, if an amount of evaporative fuel introduced directly from the fuel tank is attempted to be determined, based on a detection value of the oxygen sensor in the air-fuel ratio feedback control, the vapor can be detected first after the vapor generated in the fuel tank has passed through the evaporation passage and purge passage into the inlet pipe and then through the combustion chamber of engine and when the emissions reached the oxygen sensor provided in the exhaust pipe. Accordingly, even if in the air-fuel ratio feedback control by the oxygen sensor an appropriate maximum purge rate is tried setting in consideration of the evaporative fuel purged directly from the fuel tank to the intake passage, a delay will occur in updating the setting value thereof as long as it is determined based on the detection value of the oxygen sensor provided in the exhaust pipe. Because of this, for example, when a high-load operation causes the fuel tank to have such a high temperature that a large amount of vapor is generated in the fuel tank, the appropriate maximum purge rate cannot be set until the oxygen sensor detects the effect of the vapor generated in this large amount, which would result in a risk of degrading the emissions before it is set. Regarding this point, since the evaporative fuel processing apparatus of the present embodiment can immediately grasp the amount of generation of vapor from the detection result of the tank internal-pressure sensor 21*a*, the maximum purge rate can be set immediately according to a sudden change of vapor in the fuel tank 21, and thus degradation of emissions in this period can be suppressed fully.

Although the embodiment described above is arranged to select the minimum value as the maximum purge rate PGRMAX out of the four types of upper limits of purge rate, i.e., the time upper-limit purge rate PGTGT, full-opening purge rate PG 100, limit purge rate PGLMT, and tank vapor purge rate PGTANK, there is no need to be limited to this example. For example, the time upper-limit purge rate PGTGT, full-opening purge rate PG 100, or limit purge rate PGLMT may be corrected with the tank vapor purge rate PGTANK. Also, without selecting the maximum purge rate PGRMAX, the value of target purge rate may be compared with individual values of the four types of upper limits of purge rate as described above in order, and the point is that the target purge rate can be limited finally by the all of the four types of purge rates.

Figure 10:
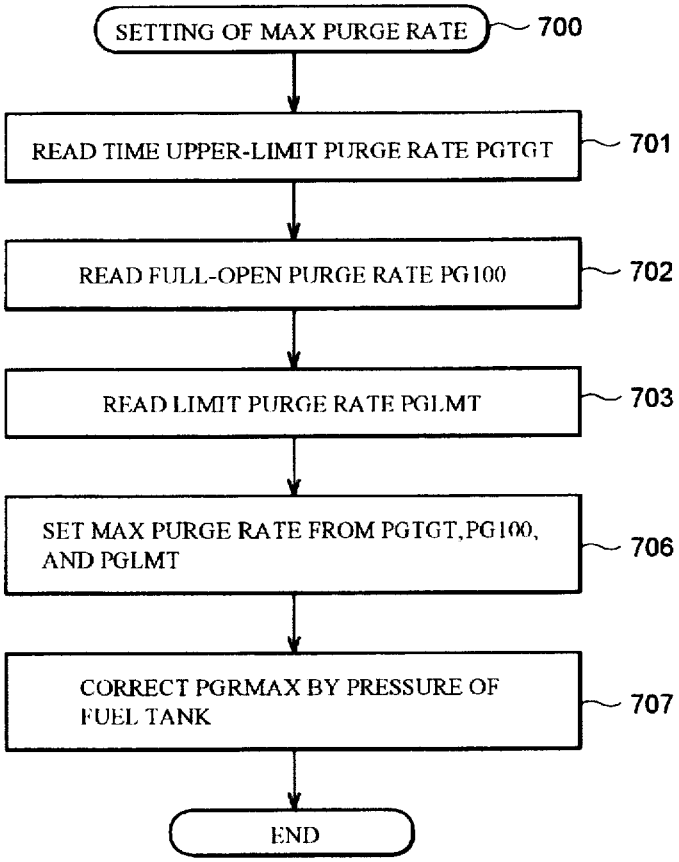
FIG. 10 is a flowchart to show another embodiment of the setting process of maximum purge rate.

Further, the tank vapor purge rate PGTANK does not always have to be calculated, but, for example as shown in FIG. 10, steps 701 to 703 are arranged to read the time upper-limit purge rate PGTGT, full-opening purge rate PG 100, and limit purge rate PGLMT in the same manner as in FIG. 7, and then step 706 is arranged to select a minimum purge rate out of the purge rates PGTGT, PG 100, and PGLMT thus read and to set it as the maximum purge rate PGRMAX. Then step 707 may be arranged to correct the maximum purge rate PGRMAX thus set, in consideration of the amount of purge introduced directly from the fuel tank 21, based on the detection result of the tank internal-pressure sensor 21*a*.

The method for estimating or detecting the amount of generation of vapor in the fuel tank may be either one of methods for detecting parameters including the temperature of the tank, load conditions of internal combustion engine (including the number of revolutions of engine, an amount of inlet air, and a ratio of them), and a remaining amount of fuel.

As described above, with the evaporative fuel processing apparatus of internal combustion engine according to the present invention, because the maximum purge rate setting means for setting the maximum purge rate comprises at least the first purge rate defining means for defining the upper limit of purge rate, based on the evaporative fuel introduced directly into the intake passage after generated in the fuel tank, an appropriate maximum purge rate can be set even under the circumstances increasing the amount of vapor to be purged directly from the fuel tank without being adsorbed to the canister. This can fully suppress the disturbance of air-fuel ratio and the degradation of emissions due to the amount of vapor introduced directly from the fuel tank.

Especially, since the evaporative fuel processing apparatus of internal combustion engine further comprises the pressure detecting means for detecting the pressure inside the fuel tank, the status of the vapor generated in the fuel tank can be detected immediately based on the detection result of this pressure detecting means, which permits the maximum purge rate to be set quickly according to the condition of generation of vapor and which also permits an appropriate maximum purge rate to be set immediately even with a sudden change in the amount of vapor generated in the fuel tank.

From the invention thus described, it will be obvious that the invention may be varied in many ways. Such variations are not to be regarded as a departure from the spirit and scope of the invention, and all such modifications as would be obvious to one skilled in the art are intended for inclusion within the scope of the following claims.

The basic Japanese Application No. 120386/1996 filed on May 15, 1996 is hereby incorporated by reference.

What is claimed is:

1. An evaporative fuel processing apparatus of internal combustion engine having an intake passage for air, comprising:

a fuel tank;

a canister;

a first passage connecting said fuel tank and said canister;

a second passage connecting said canister and said intake passage;

a valve arranged in said second passage; and a control circuit for controlling said valve so as to make a purge rate be a target purge rate, the purge rate being a ratio of the quantity of gas passing through said valve to the quantity of intake air of said intake passage, the target purge rate being set based on an operating condition of the internal combustion engine, wherein the maximum of said target purge rate is determined by evaluating at least an amount of evaporative fuel introduced directly into said intake passage after said evaporative fuel has been generated in said fuel tank.

2. An evaporative fuel processing apparatus according to claim 1, wherein the maximum of the target purge rate is the minimum in a group consisting of the maximum of the target purge rate determined by using the amount of evaporative fuel introduced directly into said intake passage after being generated in said fuel tank and the maximum of a target purge rate determined by an amount of evaporative fuel desorbing from said canister.

3. The evaporative fuel processing apparatus according to claim 1, further comprising pressure detecting means for detecting a pressure in said fuel tank, wherein said maximum target purge rate is determined based on the detected pressure by said pressure detecting means.

* * * * *